US005148764A

United States Patent [19]

Berkenheger et al.

[11] Patent Number: 5,148,764

[45] Date of Patent: Sep. 22, 1992

[54] VCR VIDEO KEEPER

[76] Inventors: Bobby Berkenheger, 3621 N. Delay Ave., Covina, Calif. 91723; George Spector, 233 Broadway Rm. 3815, New York, N.Y. 10007

[21] Appl. No.: 733,434

[22] Filed: Jul. 21, 1991

[51] Int. Cl.[5] ..... G09S 11/02

[52] U.S. Cl. ..... 116/318; 116/315; 116/311

[58] Field of Search ..... 116/223, 311, 312, 315, 116/316, 318; 40/493, 494, 495, 501, 503, 506

[56] References Cited

U.S. PATENT DOCUMENTS 1,581,374 4/1926 Youngs ..... 40/495
1,651,033 11/1927 McClellan et al. ..... 40/495
1,776,433 9/1930 Harstick ..... 40/495
2,145,984 2/1939 Knutson ..... 40/495

*Primary Examiner*—William A. Cuchlinski, Jr.
*Assistant Examiner*—W. Morris Worth

[57] ABSTRACT

A video cassette recorder index device is provided and consists of a plurality of drums that are manually rotatable vertically within a housing. Indicia is printed onto tops of the drums so that a portion of the indicia can be viewed through small window openings in the top wall of the housing. The indicia will indicate the title, tape number and place where the counter of the recorder stopped for video cassette tapes.

2 Claims, 1 Drawing Sheet

VCR VIDEO KEEPER

BACKGROUND OF THE INVENTION

The instant invention relates generally to apparatuses for retaining information and more specifically it relates to a video cassette recorder index device which provides for identifying the title, tape number and a place where the recorder stopped for a plurality of video cassette tapes. There are available various conventional apparatuses for retaining information which do not provide the novel improvements of the invention herein disclosed.

SUMMARY OF THE INVENTION

A primary object of the present invention is to provide a video cassette recorder index device that will overcome the shortcomings of the prior art devices.

Another object is to provide a video cassette recorder index device for identifying the title, tape number and a place where the counter stopped on the recorder for a plurality of video cassette tapes.

An additional object is to provide a video cassette recorder index device in which the device can be enlarged to identify additional titles, tape numbers and places where the recorder stopped.

A further object is to provide a video cassette recorder index device that is simple and easy to use.

A still further object is to provide a video cassette recorder index device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and desecribed within the scope of the appended claims.

BRIEF DESCRIPTION OF THE DRAWING FIGURES

DETAILED DESCRIPTION OF THE PREFERRED EMBODIMENTS

Figure 1:
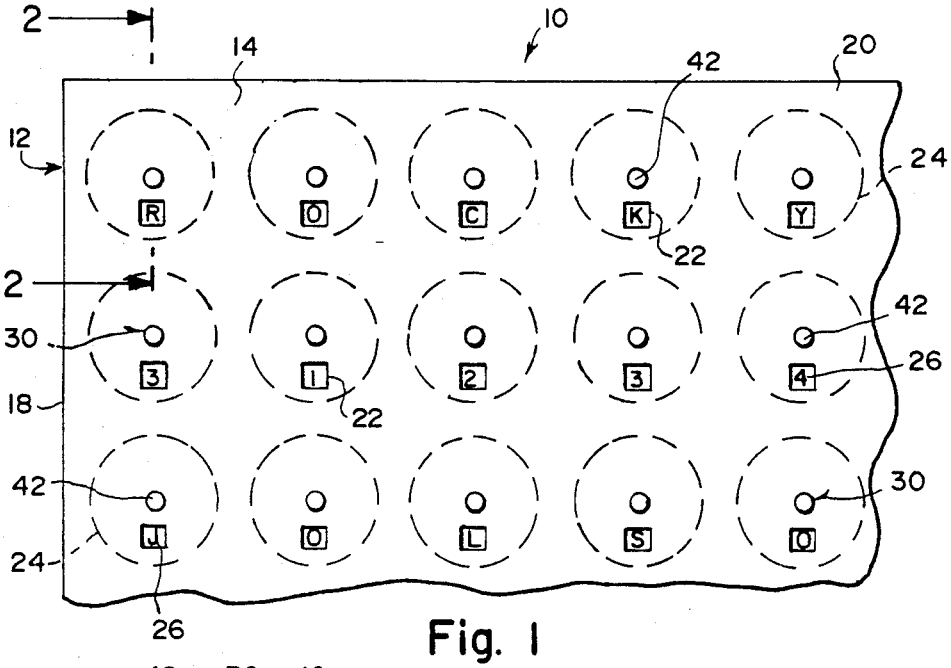
FIG. 1 is a top view of a portion of the instant invention.
Figure 2:
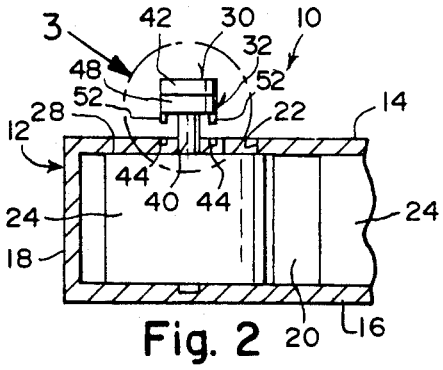
FIG. 2 is a cross sectional view taken along line 2—2 in FIG. 1.
Figure 3:
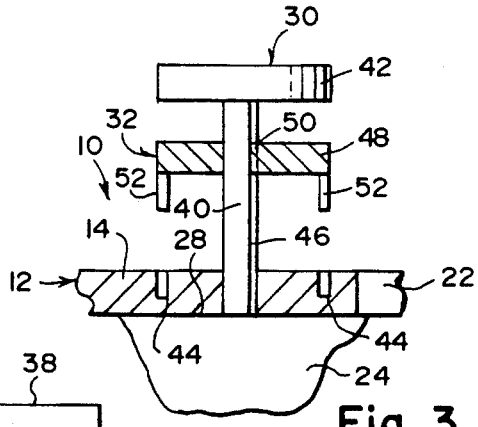
FIG. 3 is an enlarged cross sectional view as indicated by arrow 3 in FIG. 2, showing the adjustment locking mechanism on the shaft.
Figure 1A:
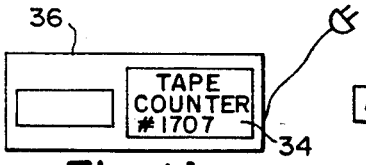
FIG. 1A is a front view of a video cassette recorder
Figure 1B:
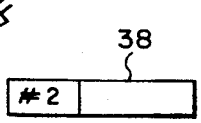
FIG. 1B is an end view of a typical cassette tape.

Turning now descriptively to the drawings, in which similar reference characters denote similar elements throughout the several views, the Figure illustrates a video cassette recorder index device 10 consisting of a box shaped housing 12 having a top 14, bottom 16, side 18 and end walls 20, with the top wall 14 having a plurality of spaced apart small window openings 22 so as to form rows therealong. Drums 24 are spaced apart and rotatable vertically within the housing 12. Indicia 26 is printed on the tops 28 of the drums 24, so that a portion of the indicia 26 on the top 28 of each drum 24 can be viewed through one of the small window openings 22 in the top wall 14 of the housing 12.

A mechanism 30 is for manually rotating each drum 24 within the housing 12, while another mechanism 32 is for adjustably locking each rotating mechanism 30 to the housing 12. The indicia 26 on the tops of the drums 24 can indicate the title, tape number and place where the counter 34 stopped on the recorder 36 for a plurality of video cassette tapes 38.

The indicia 26 can be each letter of the alphabet from A to Z on each of the drums 24 in one row to spell out the title. The indicia 26 can be each number from 0 to 9 on each of the drums 24 in another adjacent row to indicate the tape numbner and the place stopped on the counter 34 of the recorder 36.

The manually rotating mechanism 30 includes a shaft 40 extending upwardly from the center of the top 28 of the drum 24 through the top wall 14 of the housing 12. A knob 42 is affixed onto the distal end of the shaft 40 so as to be able to manually rotate the drum 24.

The adjustably locking mechanism 32 includes the top wall 14 of the housing 12 having a plurality of radial spaced recesses 44 about the shaft 40. The shaft 40 has a longitudinal slot 46 therein. A head 48 has a tongue 50 which slideably rides on the shaft 40 with the tongue engagable within the slot 46 to prevent the head 48 from rotating about the shaft 40. At least two pins 52 are spaced apart and extend downwardly from the head 48. When the head 48 is pulled all the way down on the shaft 40, the pins 52 will enter respective recesses 44 in the top wall 14 of the housing 12 to adjustably lock the drum 24 in a stationary position within the housing 12 to maintain a portion of the indicia 26 at the small window opening 22 in the top wall 14 of the housing 12.

Figure 4:
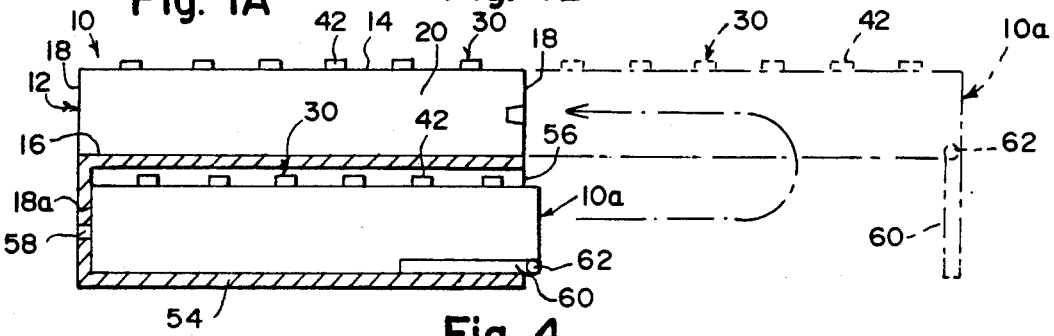
FIG. 4 is a diagrammatic cross sectional view showing an extension index device stored in a compartment below in the housing which can be pulled out and inserted within the side wall of the housing with the leg pivoted down to stabilize the index device.

As shown in FIG. 4, the housing 12 has a compartment 54 formed below with a side opening 56 therein. An extension index device 10*a* is storable within the compartment 5 of the housing 12. A peg 58 on the side wall 18*a* of the extension index device 10*a* can plug into the side wall 18 of the housing 12 so as to extend the length of the housing 12 to increase the amount of letters and numbers used to identify the video cassette tapes 38. A pivotable leg 60 is mounted at 62 on the extension index device 10*a* which can be pivoted down to stabilize the index device 10.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A video cassette recorder index device comprising:

a) a box shaped housing having a top, bottom, side and end walls with the top wall having a plurality of spaced apart small window openings so as to form rows therealong;

b) a plurality of drums with top sides each being spaced apart and rotatable vertically within said housing;

c) indicia printed on said top sides so that said indicia can be viewed through said window openings.

d) each drum having means for manually rotating said drum within said housing and to a disired position;

e) each rotating means having means for adjustably locking said rotating means to said housing at said desired position so that said indicia can be viewed through said window openings; wherein said manually rotating means includes:

f) a shaft extending upwardly from the center of the top of said drum through the top wall of said housing; and g) a knob affixed onto the distal end of said shaft so as to be able to manually rotate said drum; wherein said adjustably locking means includes:

h) the top wall of said housing having a plurality of radial spaced recesses about said shaft;

i) said shaft having an longitudinal slot therein;

j) a head having a tongue which slideably rides on said shaft with said tongue engagable within said slot to prevent said head from rotating about said shaft; and k) at least two pins spaced apart and extending downwardly from said head so that when said head is pulled all the way down on said shaft said at least two pins will enter respective recesses in the top wall of said housing to adjustably lock said drum in a stationary position within said housing to maintain a portion of said indicia of each drum at the respective small window openings in the top wall of said housing.

2. A video cassette recorder index device as recited in claim further including:

a) said housing having an end wall with a socket and a lower compartment formed below with a side opening therein;

b) an extension index device for holding additional drums storable within said compartment of said housing;

c) an end wall with a peg extending therefrom on said extension index device whereby said extension device can plug into the end wall of said housing so as to extend the length of said index device and;

d) a pivotal leg mounted on said extension index device which can be pivoted down to stabilize said index device.

* * * * *